US007946824B2

(12) United States Patent
Iwase et al.

(10) Patent No.: US 7,946,824 B2
(45) Date of Patent: May 24, 2011

(54) ELECTRIC AXIAL FLOW FAN

(75) Inventors: Taku Iwase, Ibaraki (JP); Masanori Watabe, Ibaraki (JP); Osamu Sekiguchi, Tokyo (JP); Tetsuya Hioki, Tokyo (JP); Taro Tanno, Tokyo (JP); Motoi Jin, Tokyo (JP); Yoshihiko Kato, Tokyo (JP)

(73) Assignee: Nidec Servo Co., Ltd., Gumma (JP)

( * ) Notice: Subject to any disclaimer, the term of this patent is extended or adjusted under 35 U.S.C. 154(b) by 874 days.

(21) Appl. No.: 11/930,498

(22) Filed: Oct. 31, 2007

(65) Prior Publication Data

US 2008/0101964 A1 May 1, 2008

(30) Foreign Application Priority Data

Oct. 31, 2006 (JP) ..... 2006-295087

(51) Int. Cl.
*F04D 29/38* (2006.01)
*F01B 23/08* (2006.01)

(52) U.S. Cl. ..... 416/223 R; 415/207; 415/208.1; 415/211.2; 415/223; 416/238; 416/243

(58) Field of Classification Search ..... 415/207, 415/208.1, 211.2, 220, 223; 416/223 R, 416/189, 238, 243, DIG. 5
See application file for complete search history.

(56) References Cited

U.S. PATENT DOCUMENTS 4,358,245 A * 11/1982 Gray ..... 416/189
4,569,631 A 2/1986 Gray, III
4,569,632 A 2/1986 Gray, III
4,684,324 A 8/1987 Perosino
5,273,400 A 12/1993 Amr
5,297,931 A * 3/1994 Yapp et al. ..... 415/208.1
5,320,493 A 6/1994 Shih et al.
5,431,640 A 7/1995 Gabriel
5,513,951 A 5/1996 Komoda et al.
5,931,640 A 8/1999 Van Houten et al.
6,241,474 B1 6/2001 Alizadeh et al.
6,254,476 B1 7/2001 Choi
D453,827 S 2/2002 Kuo et al.
6,413,049 B2 7/2002 Ogasawara
D463,021 S 9/2002 Huang et al.
6,554,574 B1 4/2003 Spaggiari
D485,904 S 1/2004 Tsai et al.
D486,572 S 2/2004 Chen et al.
D486,905 S 2/2004 Wang
D487,800 S 3/2004 Chen et al.
D507,343 S 7/2005 Chiu et al.
D507,641 S 7/2005 Chiu et al.
D509,584 S 9/2005 Li et al.
D511,824 S 11/2005 Chen et al.
D515,688 S 2/2006 Li
7,110,255 B2 9/2006 Ko et al.
D535,013 S 1/2007 Du
D535,737 S 1/2007 Jianjun et al.
7,273,354 B2 9/2007 Spaggiari

FOREIGN PATENT DOCUMENTS

EP 1 070 849 A2 1/2001
(Continued)

*Primary Examiner* — Igor Kershteyn
(74) *Attorney, Agent, or Firm* — Keating & Bennett, LLP

(57) ABSTRACT

In an axial flow fan, a line extending from a center axis and passing a corner where a following edge and a radially outer edge of a blade of an impeller meet is arranged forwardly in a rotational direction from an another corner where a leading edge of the blade and a radially outer surface of a hub meet. Furthermore, a camber ratio of the blade, which is minimum at a joint with the hub across the blade, monotonically increases to be maximum at the radially outer edge of the blade.

20 Claims, 15 Drawing Sheets

A

FOREIGN PATENT DOCUMENTS

| | | | |
|---|---|---|---|
| JP | 61-065096 | A | 4/1986 |
| JP | 2-2000 | B2 | 1/1990 |
| JP | 2000-161296 | A | 6/2000 |
| JP | 2007-009730 | A | 1/2007 |
| JP | 1292268 | S | 1/2007 |
| JP | 1292581 | S | 1/2007 |
| JP | 1292582 | S | 1/2007 |
| JP | 1292583 | S | 1/2007 |
| JP | 1295887 | S | 3/2007 |

* cited by examiner

A

ELECTRIC AXIAL FLOW FAN

BACKGROUND OF THE INVENTION

1. Field of the Invention

The present invention generally relates to an electric axial flow fan.

2. Description of the Related Art

An electric device (e.g., a personal computer and a server computer) conventionally includes a cooling fan used to dissipate heat generated by the electric components of the electric device. With a recent high density of the electric component in the electric device, a considerable amount of heat is accumulated in the casing. To discharge the accumulated heat, a cooling fan having a high heat dissipating capability has been called for.

The fans can be generally classified into two groups, exhausting fans discharging hot air in the casing of the electric device, and cooling fans providing air flow to the electric devices to dissipate heat generated by them. For the cooling fans, a flow direction of the air flow generated by the cooling fan can affect the heat dissipating capability thereof. In the conventional fan, however, the air flow generated thereby radially outwardly spreads and interferes with the casing thereof. It generally results in generating noises and degrading heat dissipating efficiency.

SUMMARY OF THE INVENTION

According to preferred embodiments of the present invention, an axial flow fan which provides air flow approximately along a center axis and generates less noise, and an impeller used for the fan are provided.

An impeller used for the axial flow fan includes a hub having an outer circumferential surface centered on a center axis and a plurality of blades radially outwardly extending from the outer circumferential surface of the hub to generate an air flow along the center axis when the hub rotates in a rotational direction. Each of the plurality of blades includes a leading edge which is a forward side edge in the rotational direction, a following edge which is a backward side edge in the rotational direction, and an radially outer edge connecting the leading edge and the following edge. In each of the plurality of blades, a first corner where the radially outer edge and the following edge meet is arranged forwardly in the rotational direction from a second corner where the outer circumferential surface of the hub and the leading edge meet.

Furthermore, the axial flow fan includes the impeller, a motor rotating the impeller in a manner centering on the center axis, and a casing having an inlet opening and an outlet opening connected to each other with a through hole defined by a radially inner surface. The radially inner surface of the casing radially surrounds the impeller, and an outlet-opening side of the casing includes a taper portion such that the through hole gradually expands in its size.

Other features, elements, processes, steps, characteristics and advantages of the present invention will become more apparent from the following detailed description of preferred embodiments of the present invention with reference to the attached drawings.

DETAIL DESCRIPTION OF THE PREFERRED EMBODIMENTS

Figure 1:
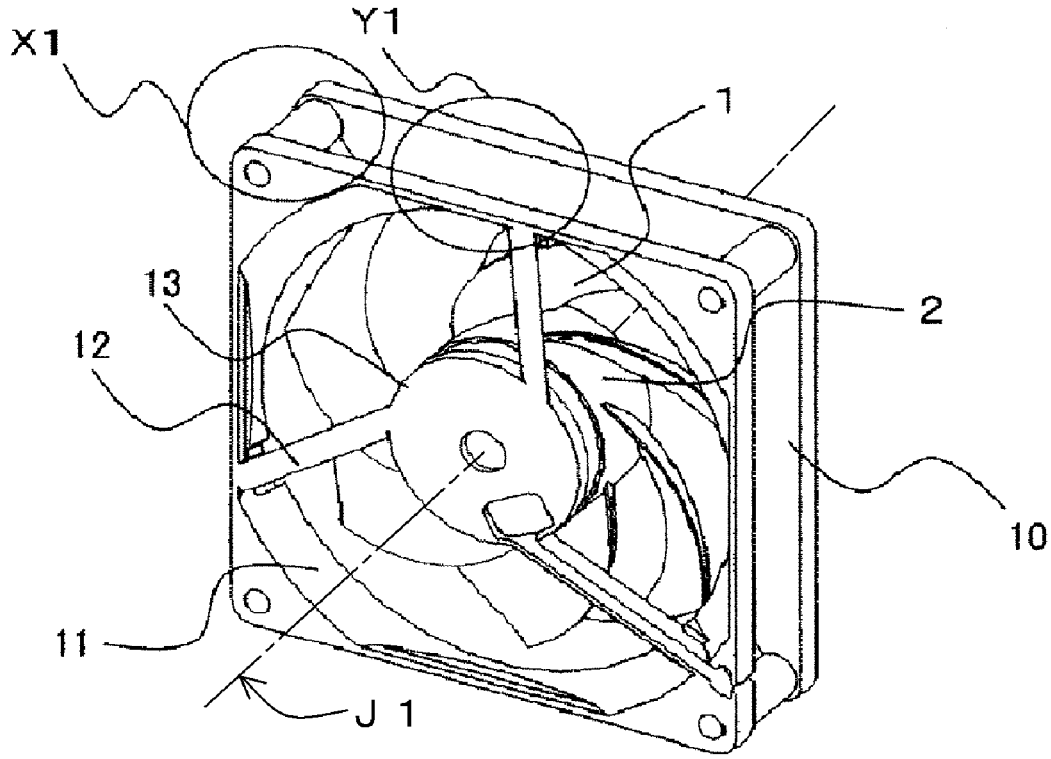
FIG. 1 is a perspective view illustrating an axial flow fan according to a preferred embodiment of the present invention.

With reference to FIG. 1, a first preferred embodiment of the present invention will be described in detail. FIG. 1 is a perspective view illustrating an axial flow fan A according to the first preferred embodiment of the present invention. The fan A includes a casing 10, a plurality of ribs 12, a motor (not illustrated in FIG. 1), and an impeller having a plurality of blades 1 and a hub 2.

The hub 2 preferably has an operculated cylindrical shape centered on a center axis J1, and a plurality of blades 1 radially outwardly extending from a radially outer surface of the hub 2 are circumferentially arranged about the center axis J1. In the present preferred embodiment of the present invention, the impeller preferably includes seven of blades 1, for example. It should be noted, however, the number of the blades 1 is not limited to seven, and may be variously modified. The motor is arranged inside the hub 2, and is fixedly supported on a base 13. The motor includes a rotor unit connected with the hub 2 and a stator unit fixedly arranged on the base 13.

A plurality of ribs 12 radially outwardly extending from a radially outer surface of the base 13 are circumferentially arranged about the center axis J1. In the present preferred embodiment of the present invention, the fan A preferably includes three of ribs 12, for example, but the number of the ribs 12 may be variously modified. The ribs 12 extend from the base 13 and reach to a radially inner surface of the casing 10. With this configuration, the base 13 is fixedly arranged relative to the casing 10.

As illustrated in FIG. 1, a contour of the casing 10 preferably is a substantially quadrangle shape when viewed along the center axis J1. There is provided a mounting hole at each of four corners of the casing 10, axially penetrating the casing in the direction along the center axis J1. Due to the quadrangle shape of the casing 10, installing of the fan A to the electric device can be facilitated. The fan A can be fixedly arranged in the electric device by screws or other fixing elements inserted into the mounting holes.

The radially inner surface of the casing 10 radially surrounds the impeller and defines a passage of air flow generated by the rotation of the impeller. The casing 10 includes an inlet from which the air is taken into the fan A and an outlet from which the air taken into the fan A is discharged (i.e., an upstream side of the air flow is the inlet and a downstream side is the outlet). An inlet side end of the radially inner surface of the casing 10 is defined with a curved surface. When the air is taken into the casing from the radially outward, the air flow interferes with the inlet side end of the casing. With the curved surface arranged at the axially inlet side end of the casing 10, it is possible to reduce the energy loss of the air flow taken into the casing from the radially outward of the casing 10.

Figure 2A:
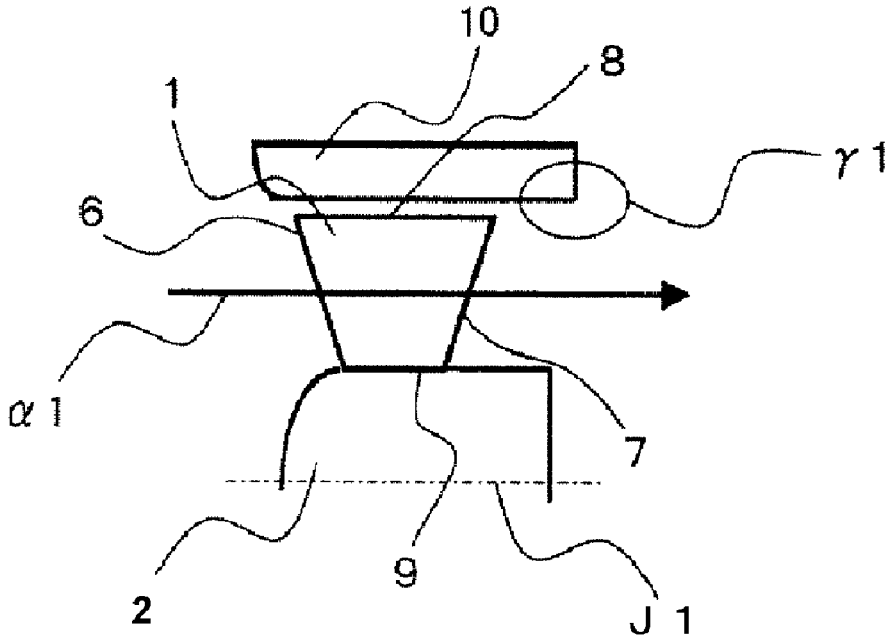
FIG. 2A is a view illustrating a vertical cross section of the axial flow fan.
Figure 2B:
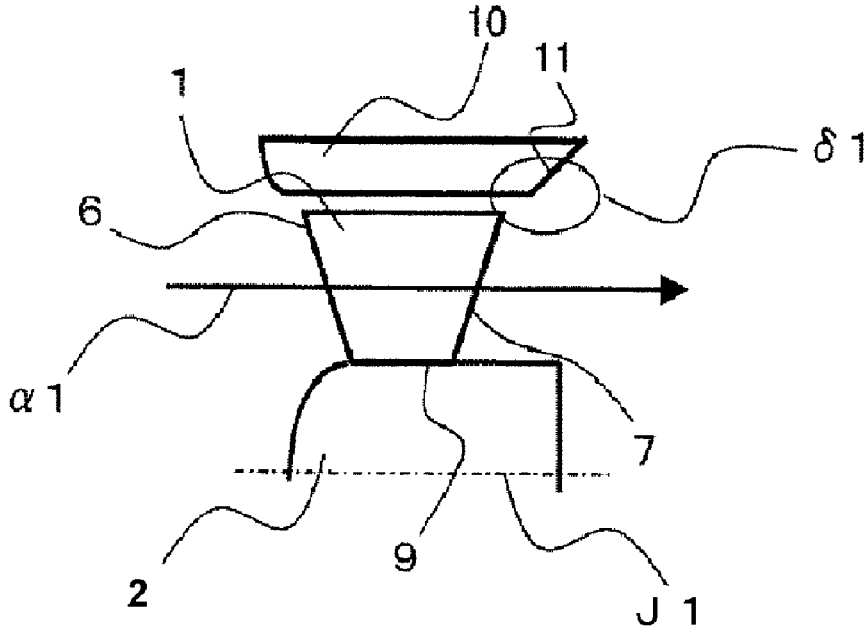
FIG. 2B is a view illustrating a vertical cross section of the axial flow fan.

As illustrated in FIGS. 1 and 2B, the fan A includes taper portions 11, at which the radially inner surface of the casing 10 is radially outwardly extends toward four corners of the quadrangle shape of the casing 10 such that the passage of air flow (i.e., a through hole defined by the radially inner surface of the casing 10) gradually expands toward the outlet side along the center axis J1. In the present preferred embodiment of the present invention, the taper portion is defined by a flat surface in a cross section thereof, but the taper portion 11 may be defined by a curved surface and the like. With this configuration, the air flow passing near the radially inner surface is discharged from the fan A along the taper portions 11. It reduces a flow resistance of the air flow, whereby it is possible to generate the air flow in an efficient manner.

Figure 15:
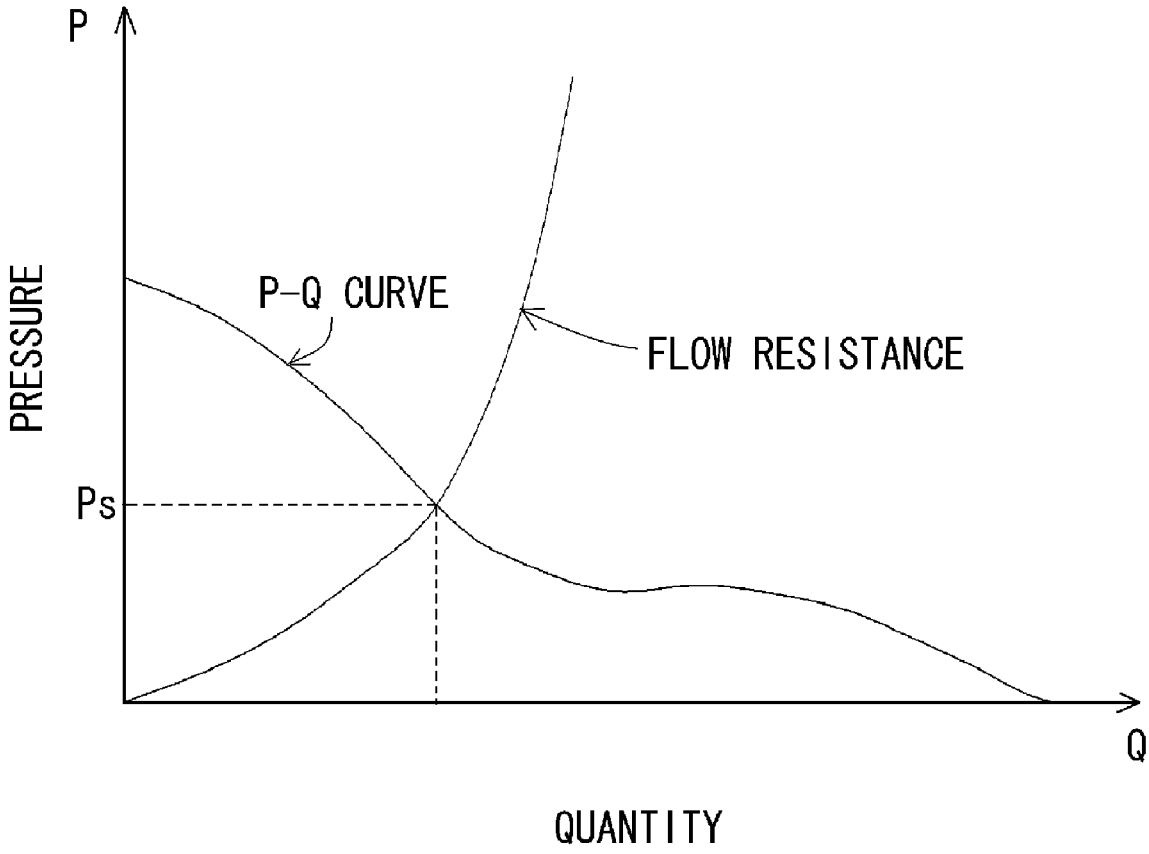
FIG. 15 is a graph illustrating a relationship between the static pressure and the flow rate (PQ curve).

When an axial flow fan is used as a cooling fan in the electric device, an object to be cooled and/or a heat exchanger is arranged at the inlet side or the outlet side of the fan. Thus, static pressure Ps is developed between the inlet side and the outlet side of the fan. The static pressure Ps is determined by the intersection of the P-Q curve (see FIG. 15) illustrating a relationship between the static pressure and the flow rate, and a flow resistance curve illustrating the flow resistance in the electric device in which the object and/or the heat exchanger is arranged. In general, certain static pressure is applied to the cooling fan used in the electric device (i.e., the cooling fan is generally driven under the situation where the static pressure Ps greater than 0 (Ps>0)).

Through the experiment the inventors carried out, under the situation in which the static pressure Ps is greater than 0, the air flow generated by the cooling fan is spread radially outwardly compared with the air flow generated under the situation where the static pressure is 0. When the air flow is radially outwardly spread, the flow rate of the air flow provided to the object to be cooled may be reduced. It results in reducing a cooling capacity of the axial flow fan. Further, it may result in generating noise when the passage of air flow at the outlet side is not a continuous rounded shape. In order to solve the problem described above, the fan A according to the present preferred embodiment of the present invention includes the impeller having a configuration described below.

Figure 3:
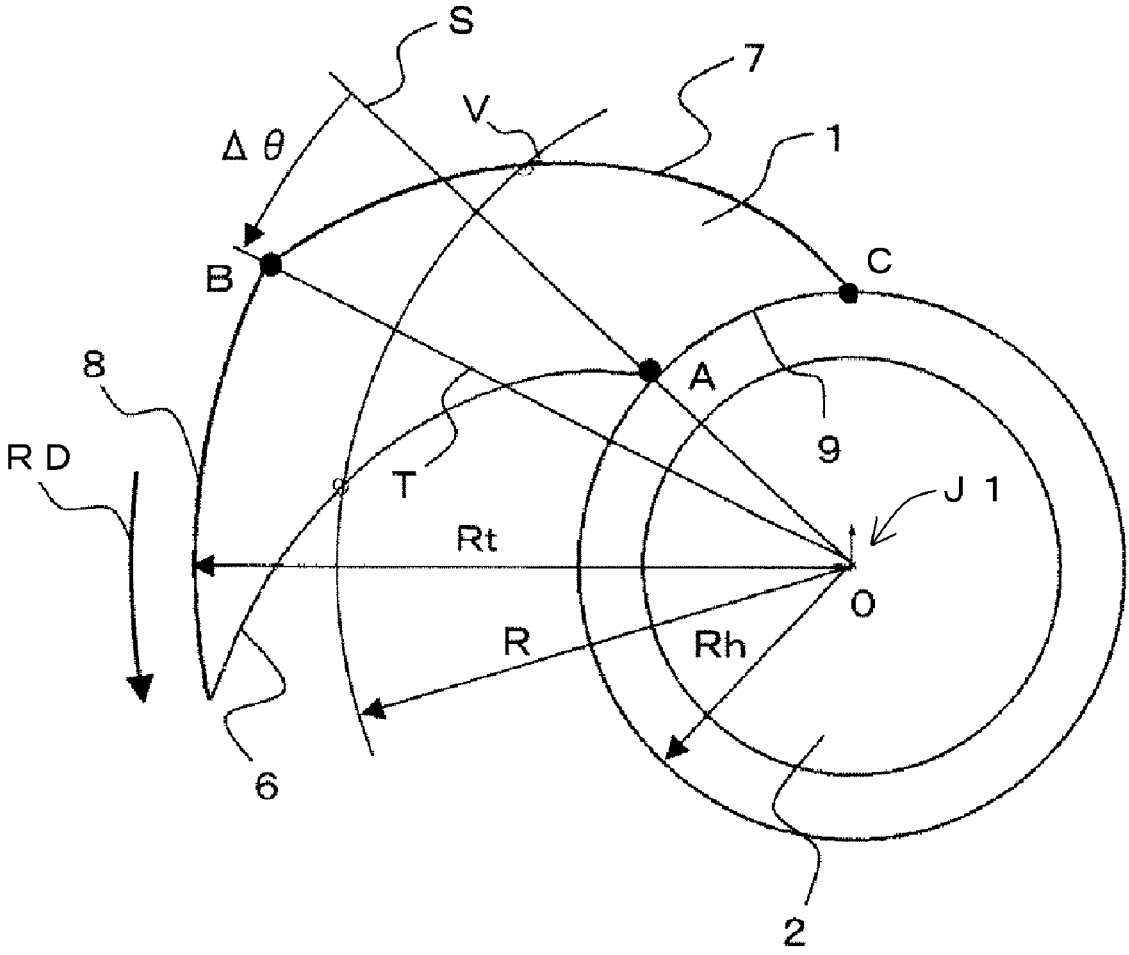
FIG. 3 is a plan view illustrating the impeller of the axial flow fan when viewed from the outlet side along the center axis.

With reference to FIG. 3, a configuration of the impeller will be described in detail. FIG. 3 is a plan view illustrating the impeller of the axial flow fan when viewed from the outlet side along the center axis J1. For convenience in the following explanation, only one of a plurality of blades 1 is illustrated in FIG. 3. The impeller rotates in a counter clockwise direction in FIG. 3 (hereinafter the direction is referred to as a rotational direction RD). The blade 1 includes a leading edge 6 which is a forward edge of the blade 1 in the rotational direction RD, a following edge 7 which is a rearward edge of the blade 1 in the rotational direction RD, and a radially outer edge 8.

A point where the leading edge 6 meets a radially outer surface 9 of the hub 2 is referred to as a corner A. The leading edge 6 is curved forwardly in the rotational direction RD relative to a line S passing through the corner A and the center axis J1. The following edge 7 has a similar configuration as that of the leading edge 6. A point where the following edge 8 meets a radially outer surface 9 of the hub 2 is referred to as a corner C. The following edge 7 is curved forwardly in the rotational direction RD relative to a line passing through the corner C and the center axis J1. The radially outer edge 8 has an arc shape centered on the center axis J1. End portions in the circumferential direction of the radially outer edge 8 are respectively connected to the radially outer ends of the leading edge 6 and the following edge 7.

A point where the radially outer edge 8 meets the following edge 7 is referred to as an corner B, and a line passing through the corner B and the center axis J1 is referred to as a line T. The line T is arranged forwardly in the rotational direction RD of the line S. The angle about the center axis between the line S and the line T are referred to $\Delta\theta$ when the rotational direction RD is regards as a plus direction.

Figure 4:
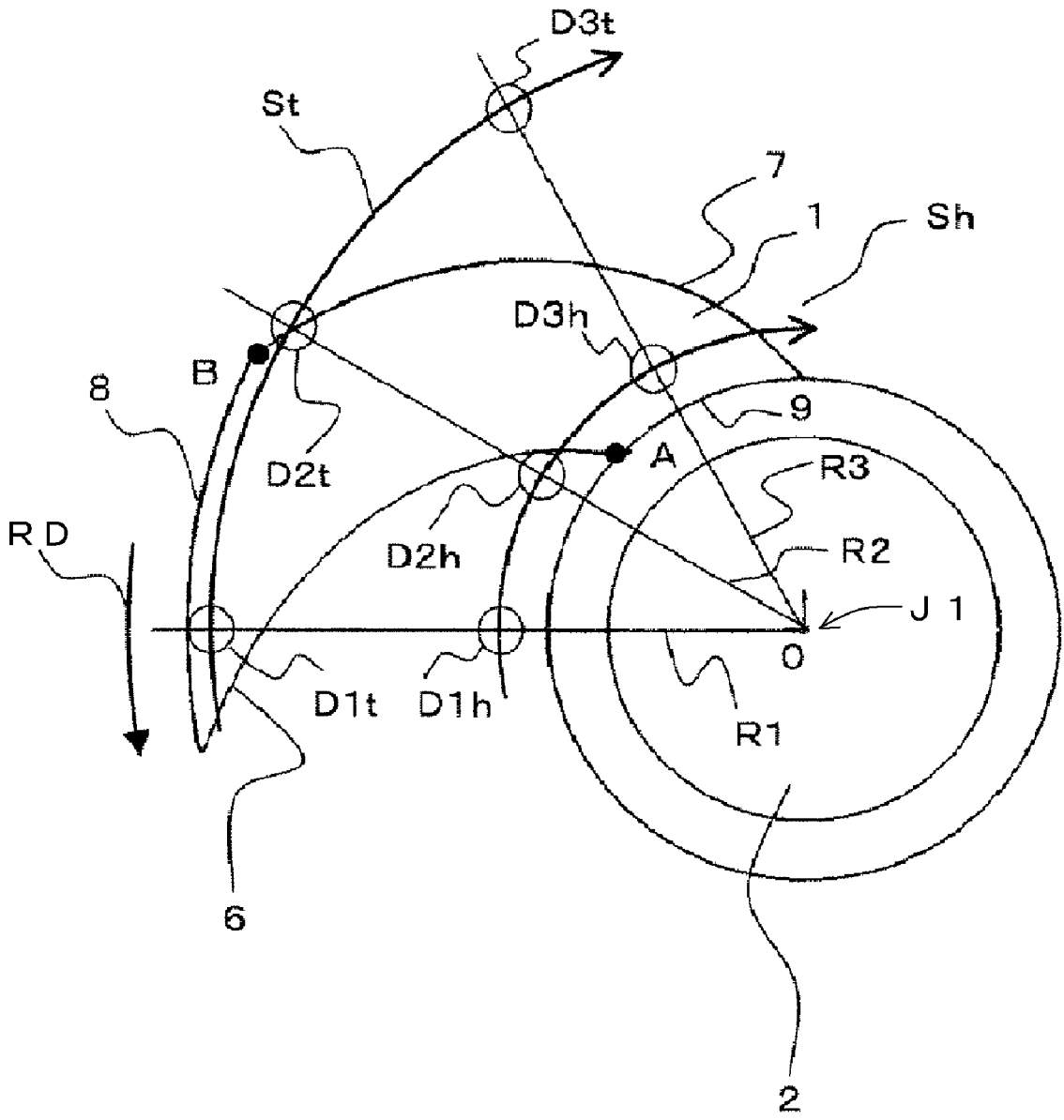
FIG. 4 is a plan view illustrating the axial flow fan viewed from the inlet side along the center axis.

Next, with reference to FIGS. 4 and 5, an operation of the axial flow fan having an above configuration will be described. FIG. 4 is a plan view illustrating the axial flow fan viewed from the inlet side along the center axis. With reference to FIG. 4, a state of air flow will be described. As illustrated in FIG. 4, a line R1 crosses the radially outer edge 8 and the leading edge 6, and then reaches to the center axis J1. A line R2 crosses the leading edge 6 and the following edge 7, and reaches to the center axis J1. The line R3 crosses the following edge 7 and reaches to the center axis J1. The line R1 is arranged forward of the corners A and B in the rotational direction RD. The line R2 extends circumferentially between the corners A and B. The line R3 is arranged rearward of the corners A and B in the rotational direction. Any lines crossing the blade 1 and reaching to the center axis J1 will be classified into three groups, the line R1, the line R2, and the line R3.

Next, an increase of the static pressure on the line R1, R2, and R3 when the impeller 1 rotates will be described in detail. An area D1*h* is arranged forward of the leading edge in the rotational direction RD and on the line R1. The static pressure in the area D1*h* is not increased by the blade 1. On the other hand, the static pressure at an area D1*t*, above the blade 1 and on the line R1, is increased by the blade 1. When the blade 1 rotates, the kinetic energy thereof is applied to the air. The static pressure of the air at the area D1*t* where the blade 1 passes is higher than that at the area D1*h* where the blade has not passed yet.

An area D2*h* is arranged forward of the leading edge in the rotational direction RD and on the line R2. The static pressure in the area D2*h* is not increased by the blade 1. A part of an area D2*t* is arranged above the blade 1 and the other part thereof is arranged rearward of the corner B and the following edge 7 in the rotational direction RD. The static pressure of the air at the area D2*t* is fully increased by the blade 1. The static pressure of the air at the area D2*t* where the blade 1 passes is higher than that at the area D2*h* where the blade 1 has not passed yet.

An area D3*h* is above the blade 1 and arranged rearward of the corner A in the rotational direction RD. However, since the area D3*h* is arranged forward of the following edge 7 in the rotational direction RD, the static pressure of the air at the D3*h* is not yet fully increased by the blade 1. In contrast, since an area D3*t* is arranged rearward of the following edge 7 and the corner B in the rotational direction RD, the static pressure of the air at the D3*t* is fully increased by the blade 1. As described above, the static pressure of the air at the area D3*t* where the blade 1 has passed is higher than that at the area D3*h* where the blade is passing.

As described above, due to the shape of the blade 1 according to the present preferred embodiment of the present invention, on any line extending in the radial direction from the center axis J1, the static pressure of the air is higher at the radially outer edge 8 side than that at the rotor hub 2 side. Due to the static pressure difference, a spread of the air flow in the radially outward direction is restricted. Thus, as illustrated in FIG. 5, air is blown along stream lines Sh and St (i.e., in a direction along the center axis J1).

As described above, the static pressure is higher at the outer edge 8 side than that in the hub 2 side. With the higher static pressure in the outer edge 8 side, the air may flow upstream (i.e., air may flow from the outlet side to the inlet side) at a location between the casing 10 and the outer edge 8 of the impeller. In the present preferred embodiment of the present invention, the outer edge 8 has an arc shape centered on the center axis J1, and thus, a clearance in the radial direction between the casing 10 and the outer edge 8 is maintained in a constantly narrow manner. With the configuration, the upstream flow of the air at a location between the outer edge 8 and the casing 10 is restricted. Furthermore, as the clearance in the radial direction between the outer edge 8 and the casing 10 becomes narrower, the static pressure at the outer edge 8 side becomes greater.

Figure 5:
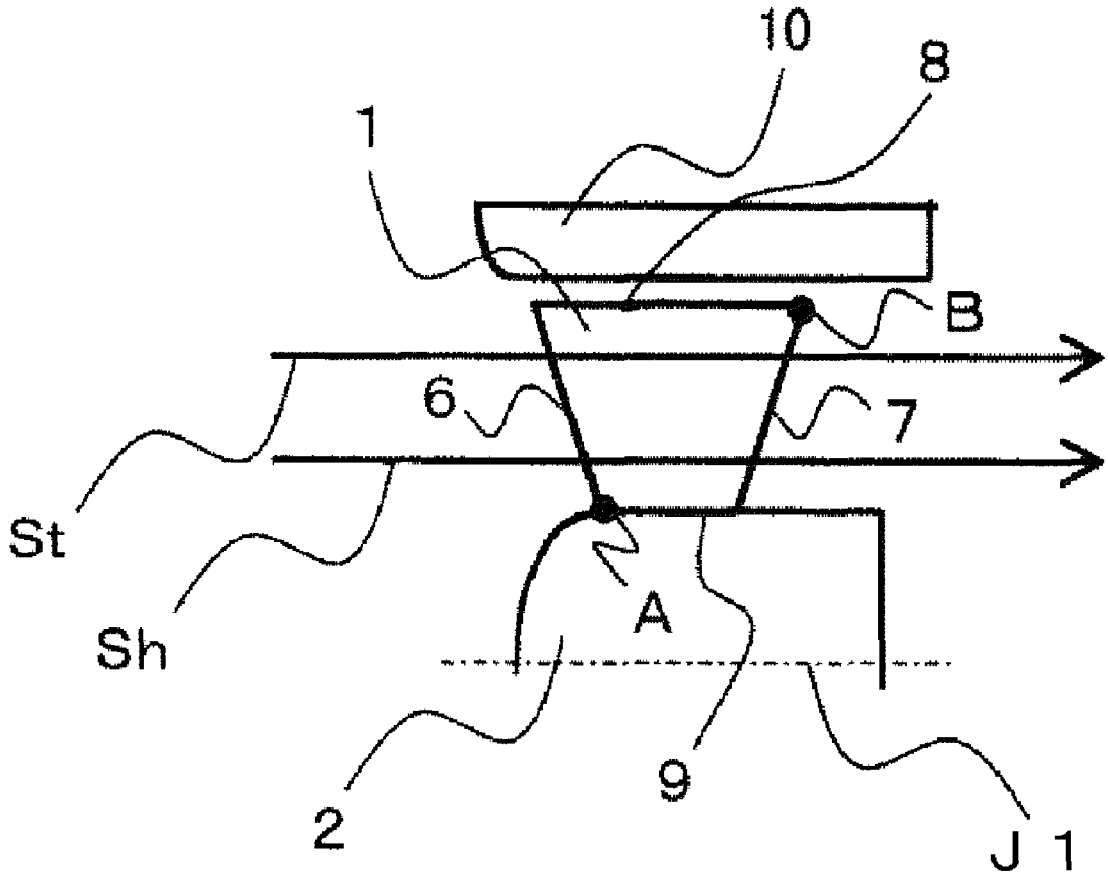
FIG. 5 is a view illustrating a partial cross section of the axial flow fan along the center axis, and flow of the air in the axial flow fan.

FIG. 5 is a view illustrating a partial cross section of the fan A along the center axis J1, and flow of the air in the fan A. The casing 10 of fan A illustrated in FIG. 5 preferably does not include the taper portion 11. According to the present preferred embodiment of the present invention, the air is blown along the center axis J1 and thus the taper portion 11 which is provided to reduce the flow resistance of the air flow is not necessarily provided to the casing 10. It should be noted that the stream lines Sh and St are illustrated in FIG. 5 as being parallel to the center axis J1 for the convenience of illustration, but in reality, the air flows in a swirling manner.

Figure 6:
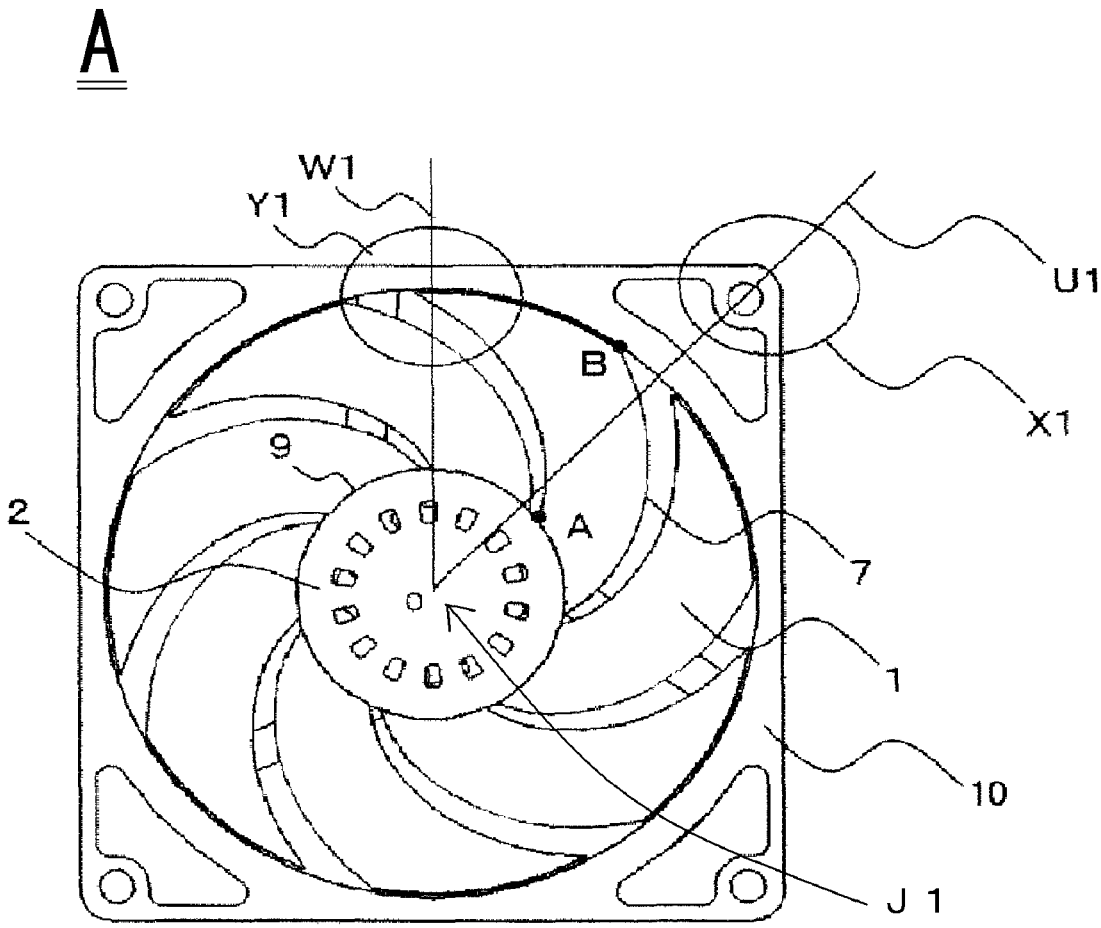
FIG. 6 is a plan view illustrating the axial flow fan.
Figure 13:
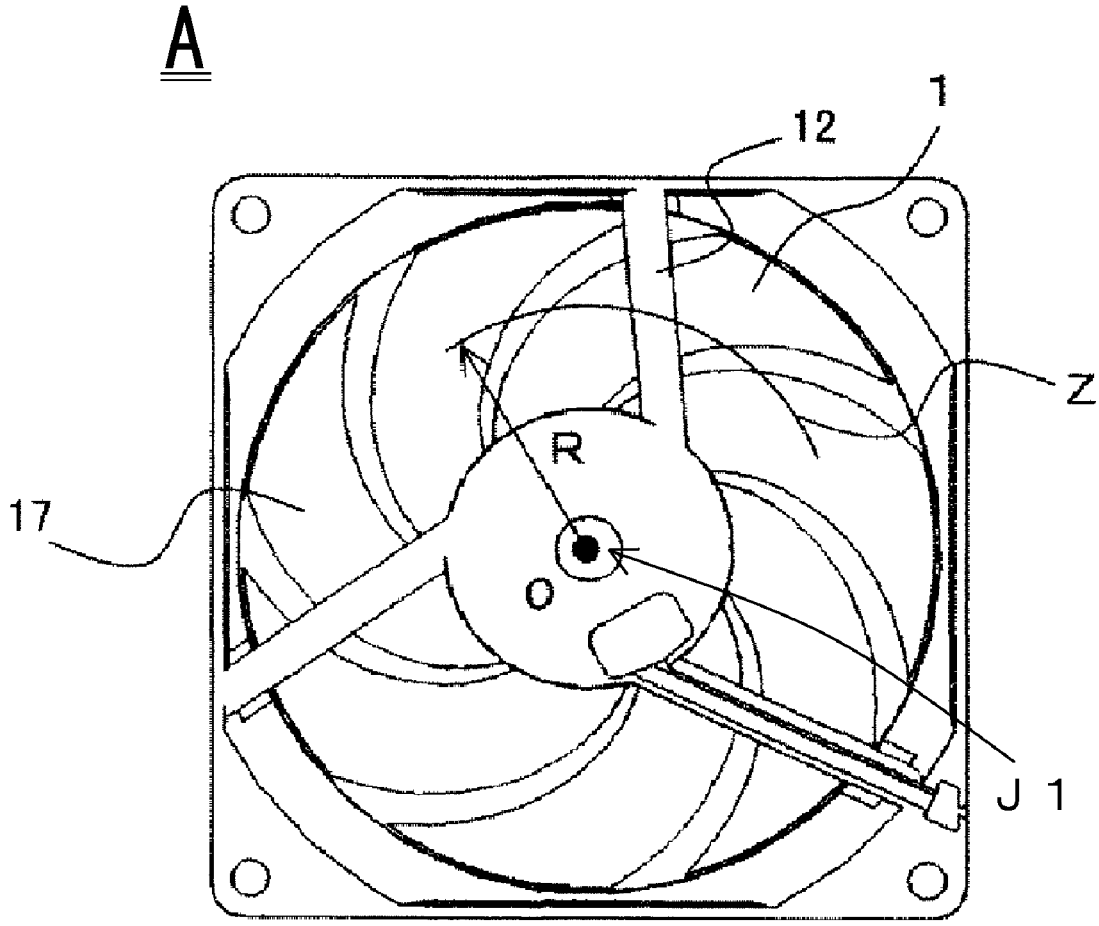
FIG. 13 is a plan view illustrating the axial flow fan when viewed along the center axis from the outlet side.

FIGS. 6 and 13 are plan views illustrating the fan A according to the present preferred embodiment of the present invention. A line U1 extending in the radially outward direction from the center axis J1 and passing a corner X1 of the casing 10 and a line W1 extending in the radially outward direction from the center axis J1 and passing a middle Y1 of a side of the outer shape of the casing 10 are illustrated in FIG. 6. FIG. 2A is a view illustrating a vertical cross section of the fan A along the line U1, and FIG. 2B is a view illustrating a vertical cross section of the fan A along the W1.

As illustrated in FIGS. 1, 2A, and 2B, the downstream side of the casing 10 preferably includes four of taper portions 11 extending toward the corners of the casing 10, respectively, and approximately flat portions at the middles of the sides of the casing 10. As described above, when the air is blown in a radially spreading manner by a conventional fan, the air flow interfered with the flat portions 11, thereby preventing smooth air flow. In addition, due to the interference between the air and the flat portions 11, the noise may be generated. In the present preferred embodiment of the present invention, the spreading of the air flow in the radial direction is restricted, thus, the interference between the air flow and the flat portions 11 and the generation of the noise are prevented.

In the conventional fan, the air flow generated thereby spreads radially outwardly and interferes with the downstream side end of the casing 10 (corresponding to a portion γ1 illustrated in FIGS. 2A and 2B) and may generate noise. In the present preferred embodiment of the present invention, due to the impeller configuration described above, the generation of the noise is prevented.

Figure 7:
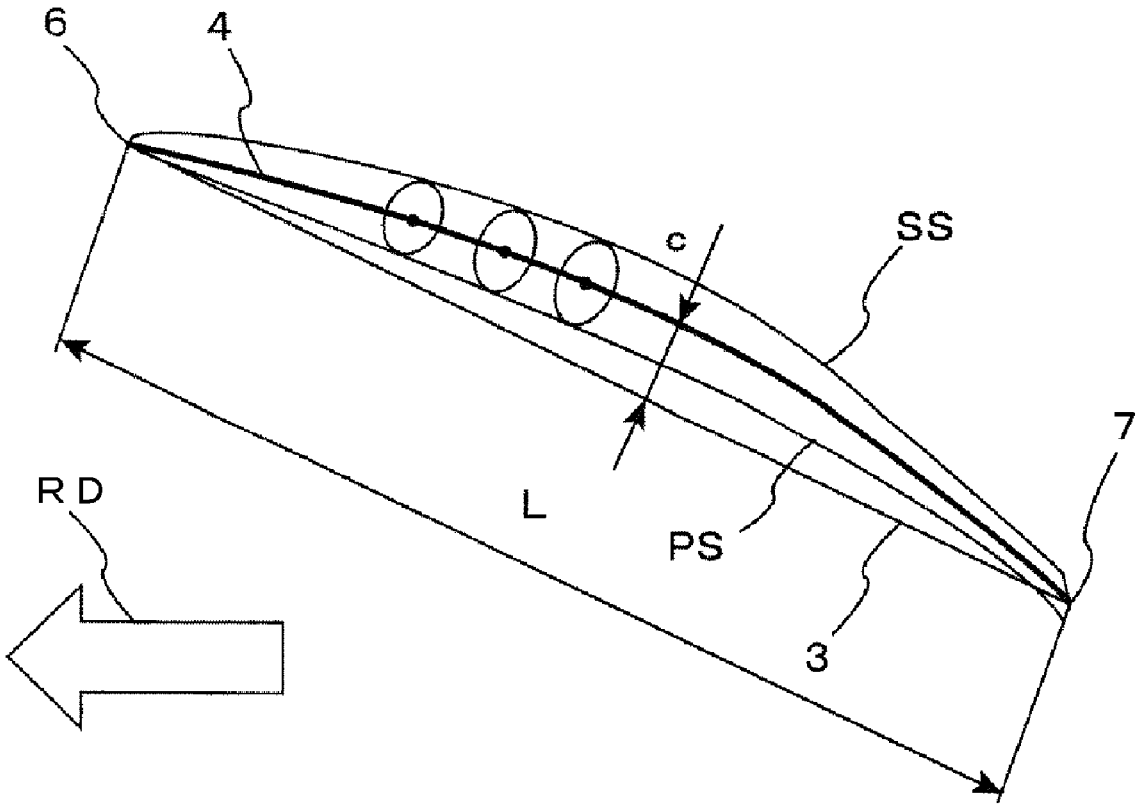
FIG. 7 illustrates a cross section of the blade along a virtual circle having a radius R and centered on the center axis.

FIG. 7 illustrates a cross section of the blade 1 along a virtual circle having a radius R and centered on the center axis J1. In FIG. 7, a chord line 3 of the blade 1 connecting the leading edge 6 and the following edge 7, a length L of the chord 3, a pressure surface PS, a suction surface SS, a center line 4 of the blade 1, and a camber c representing a camber amount of the blade 1, are illustrated. The camber amount is a maximum distance between the center line 4 and the chord line 6 in a direction perpendicular to the chord line 3. A camber ratio f is represented by a formula c/L (the camber amount c divided by the length L of the chord line 3).

Figure 8:
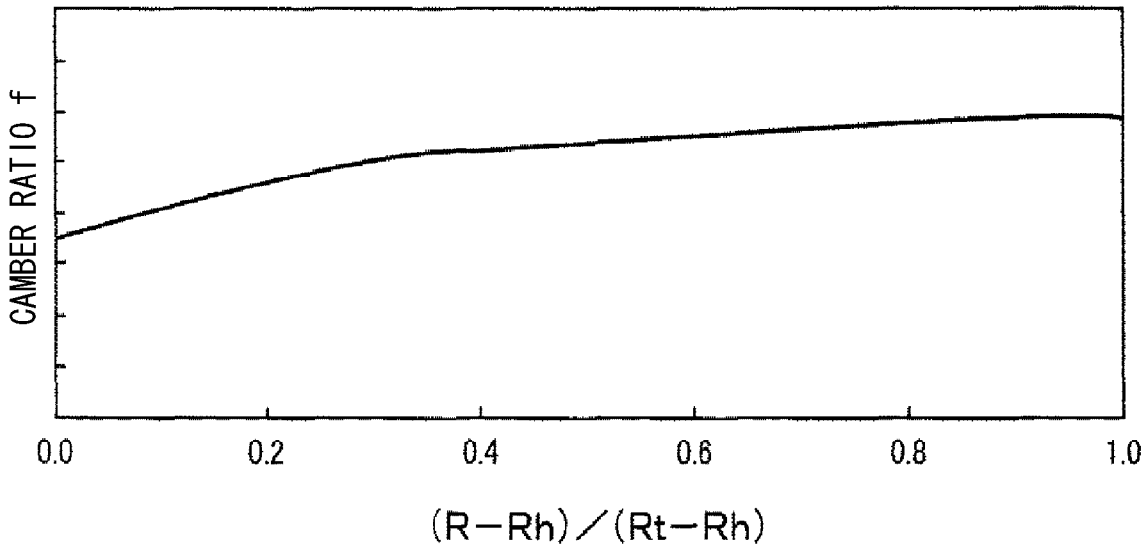
FIG. 8 is a graph describing a relationship between the chamber ratio f and the radius R.

FIG. 8 is a graph describing a relationship between the chamber ratio f and the radius R according to the present preferred embodiment of the present invention. In FIG. 8, the radius R is normalized by the formula (R−Rh)/(Rt−Rh), wherein R represents the radius of the virtual circle, Rh represents a radius of the hub 2, and Rt represents a blade tip radius of the impeller, i.e., when the radius R is 0.0, the radius R equals the hub radius Rh. When the radius R is 1.0, the radius R equals the blade tip radius Rt.

For convenience in the following description, the camber ratio f at the blade tip is referred to as a camber ratio ft, and the camber ratio at a joint with the hub 2 is referred to as a camber ratio fh. In the present preferred embodiment of the present invention, the camber ratio is minimum at the joint with the hub 2 and is maximum at the blade tip. The camber ratio f monotonically increases from the minimum camber ratio fh toward the maximum camber ratio ft as illustrated in FIG. 8. By maximizing the camber ratio at the blade tip having the greatest rotational speed in the blade, it is possible to increase the static pressure at the blade tip side.

The configuration of the camber ratio f described above may be combined with the feature in which the angle between the corner A of the blade 1 is arranged at the downstream side from the corner B of the blade 1 as illustrated in FIG. 3 (i.e., the angle Δθ is greater than 0) to generate air flow in the direction along the center axis J1. As a result, the cooling capacity of the fan A may be increased.

Figure 9:
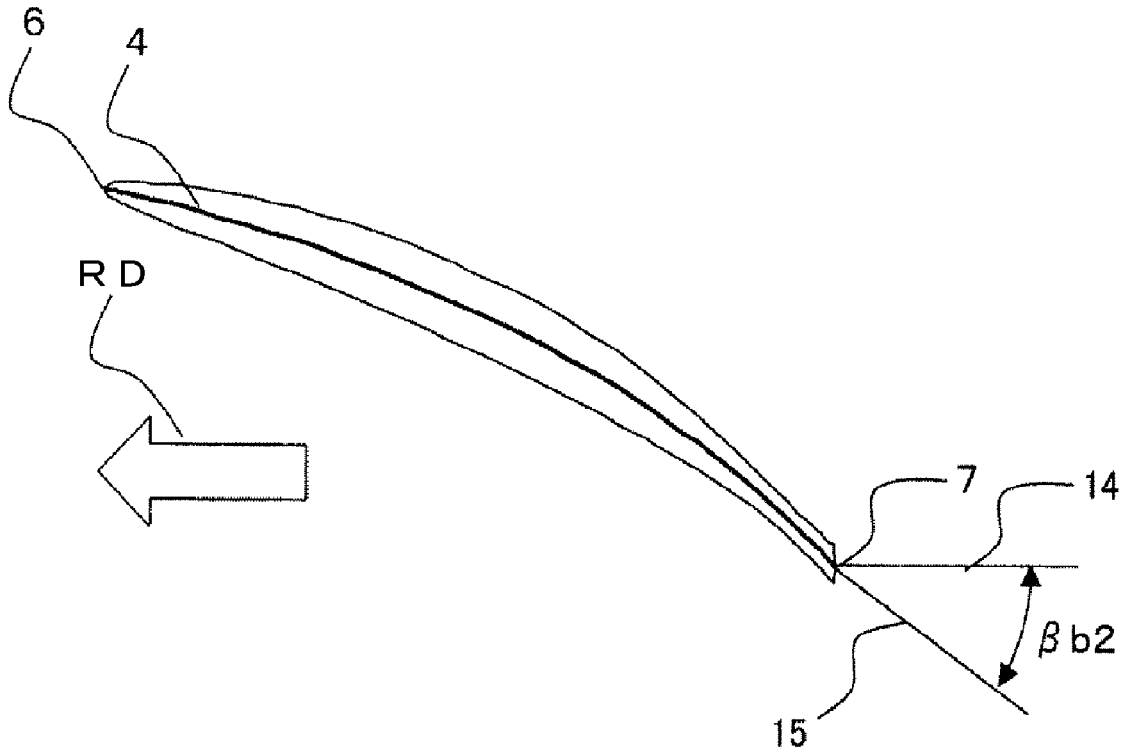
FIG. 9 illustrates a cross section of the blade along a virtual circle having a radius R and centered on the center axis.

Next, with reference to FIGS. 9 and 10, an outlet angle of the blade 1 will be described in detail. FIG. 9 illustrates a cross section of the blade 1 along a virtual circle having a radius R and centered on the center axis J1. A line 14 is a line parallel to the rotational direction RD, and a line 15 is a tangent line of the center line 4 at the following edge 7. The outlet angle βb2 is an angle between the lines 14 and 15.

Figure 10:
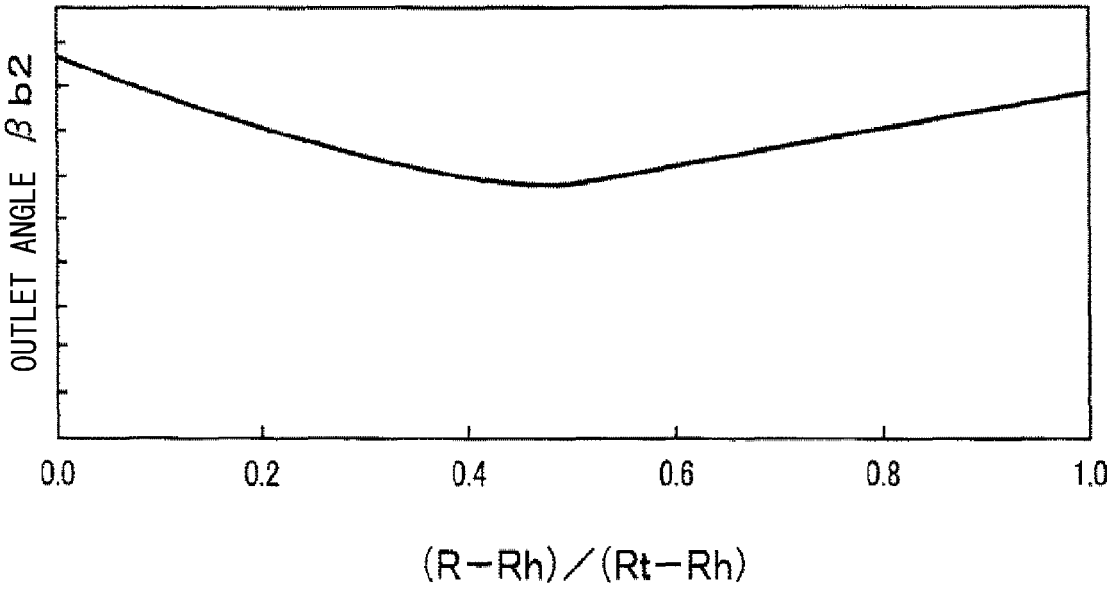
FIG. 10 is a graph illustrating a relationship between the radius R and the outlet angle $\beta b2$.

FIG. 10 is a graph illustrating a relationship between the radius R and the outlet angle βb2 according to the present preferred embodiment of the present invention. In FIG. 10, the radius R is normalized by the formula (R−Rh)/(Rt−Rh), wherein R represents the radius of the virtual circle, Rh represents a radius of the hub 2, and Rt represents a blade tip radius of the impeller. When the radius R is 0.0, the radius R equals the hub radius Rh. When the radius R is 1.0, the radius R equals the blade tip radius Rt. In the present preferred embodiment of the present invention, the outlet angle becomes minimum at between the joint and the blade tip, then, the outlet angle monotonically increases toward the blade tip.

The configuration of the outlet angle described above may be combined with the feature described in FIG. 3 in which the angle $\Delta\theta$ is greater than 0 to increase the static pressure at the blade tip.

Figure 11A:
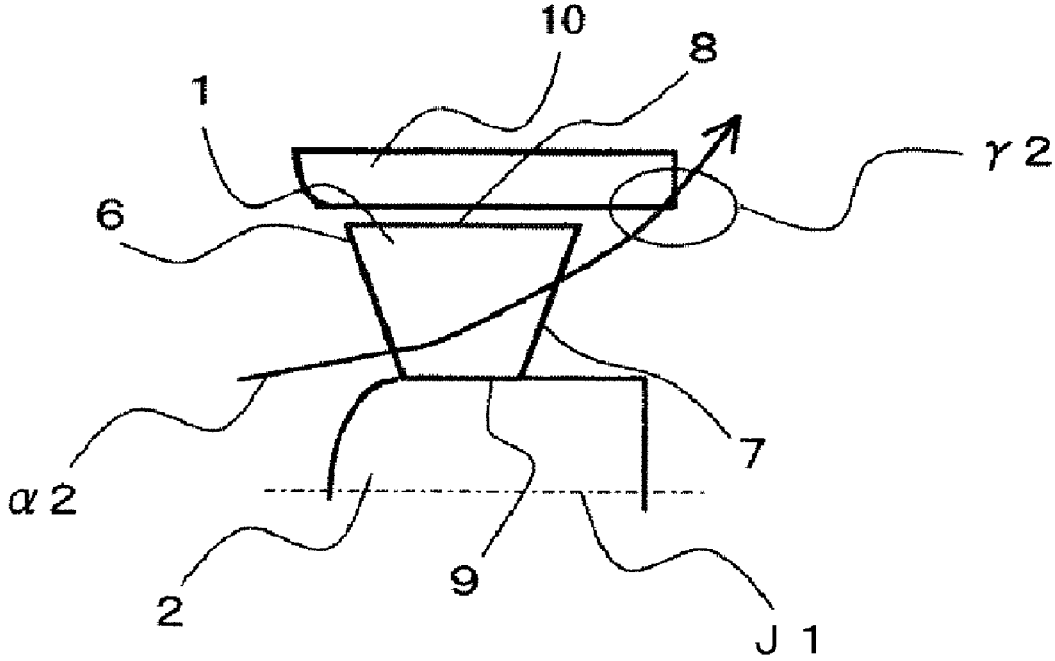
FIG. 11A illustrates a cross section of a conventional fan, and an air flow generated thereby.
Figure 11B:
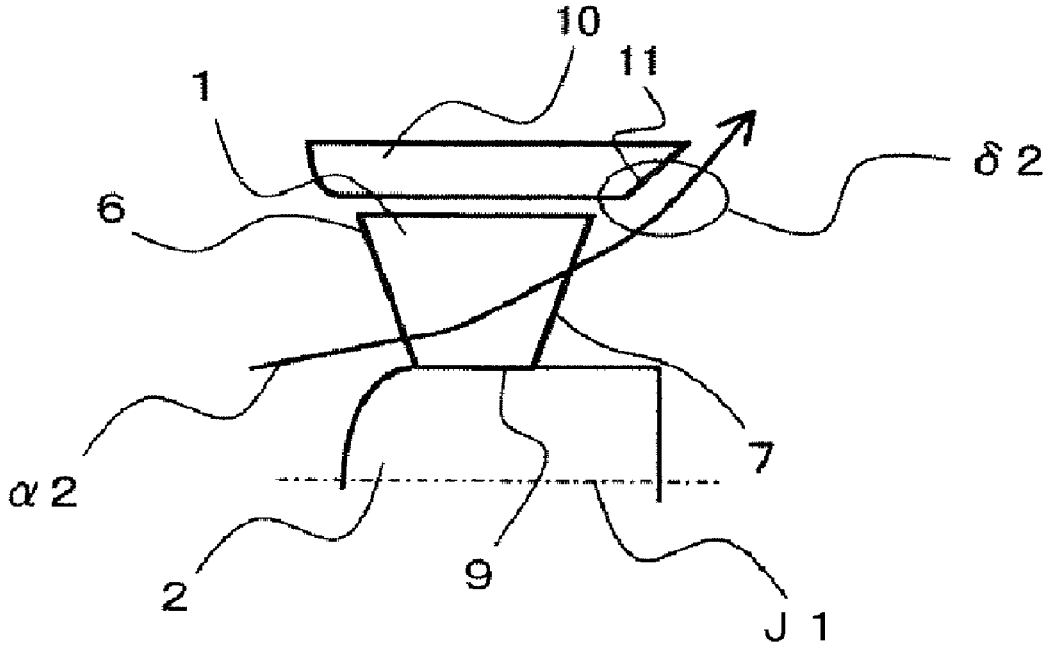
FIG. 11B illustrates a cross section of a conventional fan, and an air flow generated thereby.

FIGS. 11A and 11B illustrate cross sections of a conventional fan, and an air flow generated thereby. As illustrated in FIGS. 11A and 11B, the air flow generated by the conventional fan spreads radially outwardly. With the taper portions 11, the air flows along the taper portions 11 without interfering with the downstream side end of the casing 10. In the portions without taper portions 11 as illustrated in FIG. 11A, the air flow interferes with the downstream side end of the casing 10 and may generate the noise. In the preferred embodiment of the present invention, the air is blown in the direction along the center axis J1, and the interference between the air flow and the casing 10 is restricted. Thus, generation of the noise is prevented.

Figure 12:
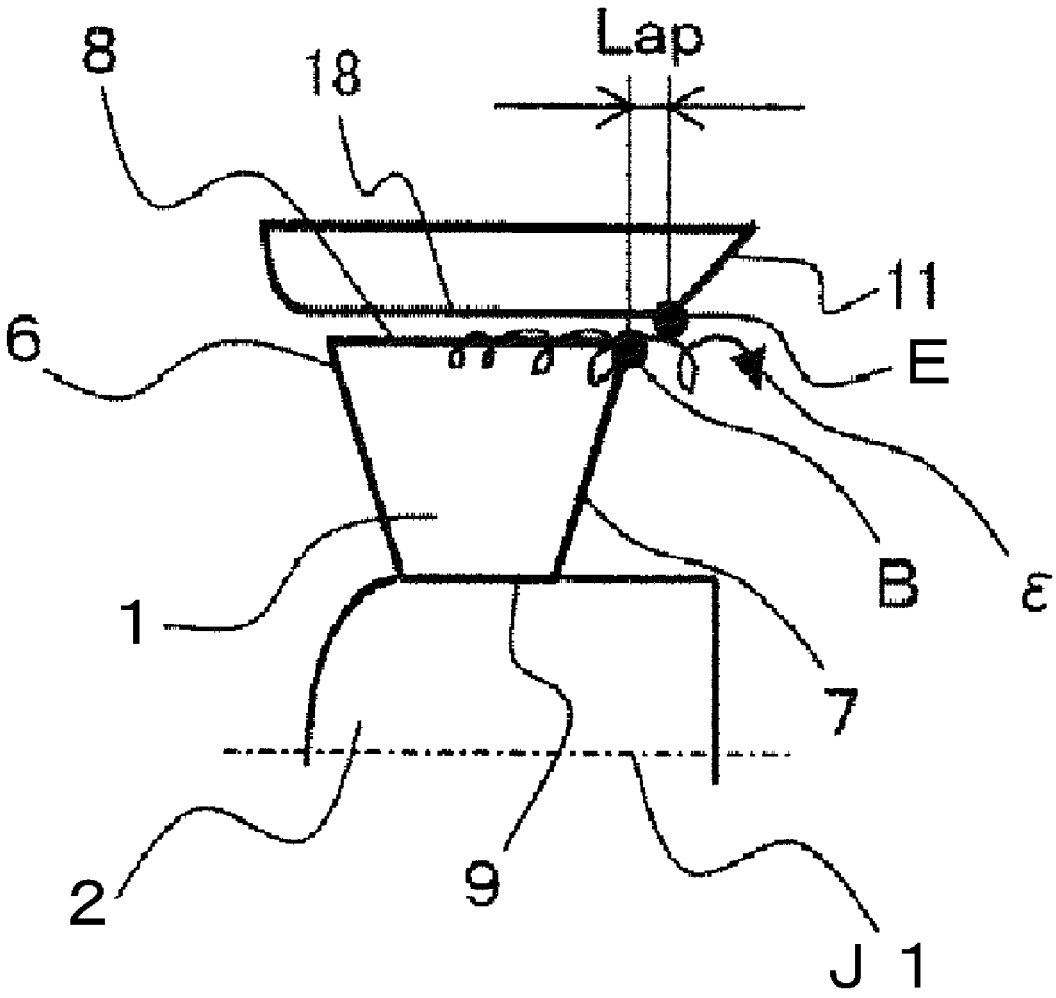
FIG. 12 is a view illustrating a partial cross section of the fan along a surface passing the center axis J1 and the taper portion, and flow of the air in the axial flow fan.

FIG. 12 is a view illustrating a partial cross section of the fan A along a surface passing the center axis J1 and the taper portion 11, and flow of the air in the fan A according to the present preferred embodiment of the present invention. A portion where a radially inner surface 18 of the casing 10 and the taper portion 11 meet is referred to as a corner E. As illustrated in FIG. 12, the corner B of the blade 1 (see FIG. 3) is arranged at an upstream side (i.e., the inlet side) from the corner E (i.e., the corner B is radially surrounded by the radially inner surface 18 such that the corners B and E are not arranged in an radially overlapping manner). The distance along the center axis J1 between the corners B and E is illustrated as "Lap" in FIG. 12. A configuration illustrated in FIG. 12, in which the corner B is arranged upstream side along the center axis J1 from the corner E, is defined as being in a state "Lap>0".

When an object moves in the air, the Karman's Vortex Street occurs in the trail of the object as the air stream that flows around the object fails to conform to the shape of the object. The number of the Karman's Vortex to be developed is proportional to a moving speed of the object. When the impeller of the fan A rotates, the Karman's Vortex is developed in the trail of each blade 1 (i.e., the Karman's Vortex is generated in the downstream side of the blade 1 in the rotational direction RD). In the present preferred embodiment, due to the streamline of the cross section of the blade 1 as illustrated in FIG. 7, the Karman's Vortex does not develop toward the direction to which the air flows. It should be noted, however, in the radially outside of the outer edge 8 of the blade 1, a vortex $\epsilon$ is slightly developed.

In the present preferred embodiment of the present invention, due to the configuration in which the corner B is arranged at an upstream side of the air flow, the vortex $\epsilon$ is prevented from interfering with the taper portion 11. Thus, the air flows smoothly in the fan A and the generation of the noise is prevented.

Figure 14:
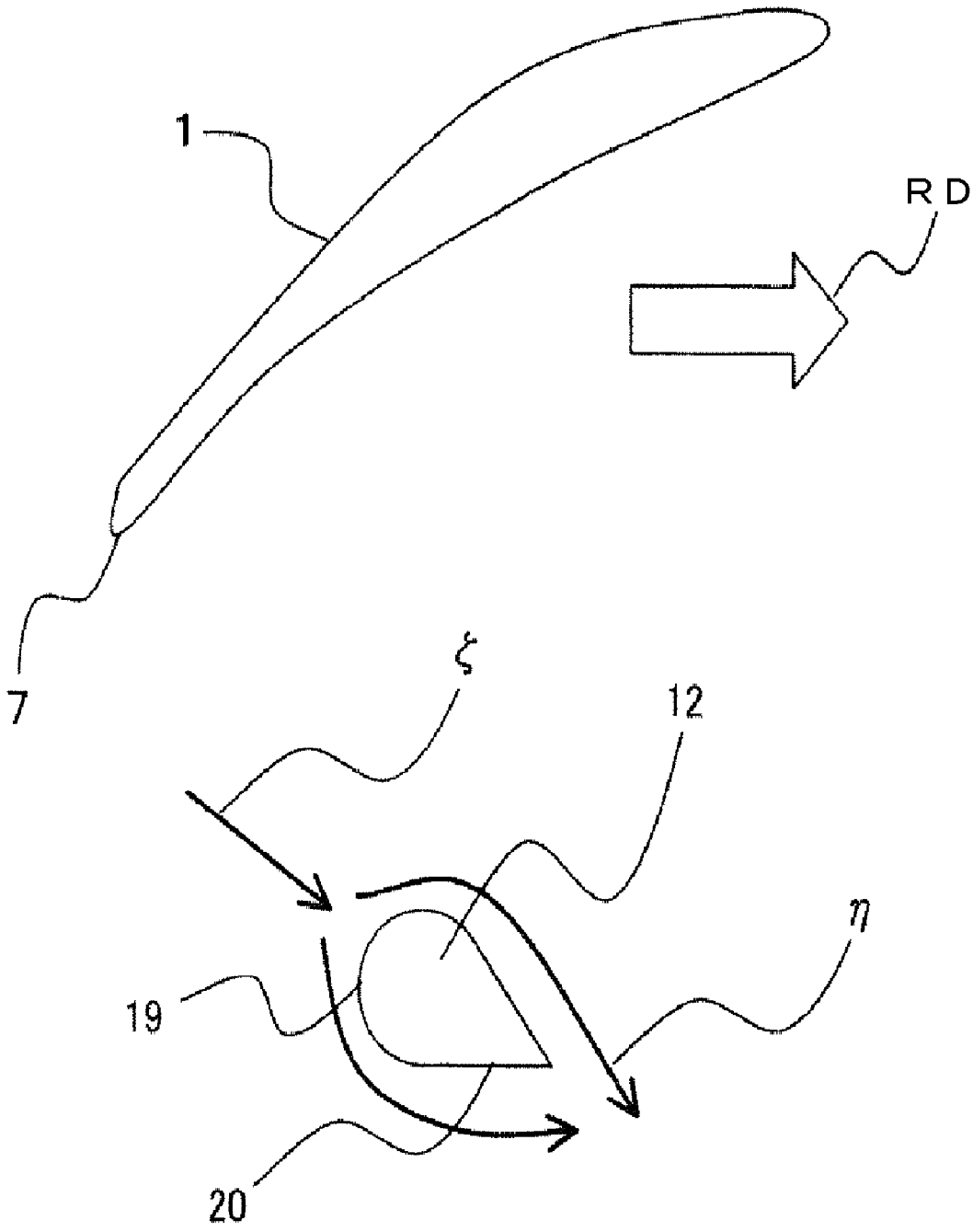
FIG. 14 illustrates cross sections of the rib and the blade along a virtual arc having a radius R and centered on the center axis J1.

Next, with reference to FIGS. 13 and 14, a shape of the rib 12 will be described. FIG. 13 is a plan view illustrating the fan A when viewed along the center axis J1 from the outlet side. FIG. 14 illustrates cross sections of the rib 12 and the blade 1 along a virtual arc Z having a radius R and centered on the center axis J1. As illustrated in FIG. 14, the cross section of the rib 12 has an approximately teardrop shape having a spherically rounded head 19 and a frustum tail 20. The rounded head 19 is directed to the upstream side relative to the frustum tail 20 in the fan A such that the rounded head 19 faces the following edge 7 of the blade 1.

With the configuration described above, the air flow $\zeta$ generated by the blade 1 flows along the cross section of the rib 12 as the air flow $\eta$ illustrated in FIG. 14, and thus, the generation of the turbulence is suppressed. It should be noted that the shape and the arrangement of the cross section of the rib 12 is not limited to the teardrop shape. The shape may be a stream-line and the like shape suppressing the generation of the turbulence. Furthermore, the rib 12 may have a teardrop shape whose frustum tail is arranged upstream side in the fan A such that the frustum tail faces the following edge 7.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An impeller for use in an axial flow fan, the impeller comprising:

a hub including a radially outer surface and centered on a center axis; and a plurality of blades extending radially outwardly from the radially outer surface of the hub to generate an air flow along the center axis when the hub rotates in a rotational direction, each of the plurality of blades includes a leading edge which is a forward side edge in the rotational direction, a following edge which is a rearward side edge in the rotational direction, and a radially outer edge connecting the leading edge and the following edge; wherein a first corner where the radially outer edge and the following edge meet is arranged forward in the rotational direction relative to a second corner where the radially outer surface of the hub and the leading edge meet in each of the plurality of blades; and the plurality of blades are arranged such that the radially outer edge of each of the plurality of blades is not connected to other radially outer edges of the remaining ones of the plurality of blades.

2. The impeller as set forth in claim 1, wherein the radially outer edge of each of the plurality of blades has a substantially arc shape centered on the center axis.

3. The impeller as set forth claim 1, wherein an outlet angle of each of the plurality of blades is defined by an angle between a line substantially parallel to the rotational direction and passing the following edge, and a tangent line at the following edge of a center line passing a middle of each of the plurality of blades in the cross section of each of the plurality of blades along the virtual circle centered on the center axis, and the outlet angle becomes minimum at a point between a joint where each of the plurality of blades meets the radially outer surface of the hub and the radially outer edge of each of the plurality of blades, and the outlet angle monotonically increases from the point to the radially outer edge.

4. An axial flow fan comprising:

the impeller as set forth in claim 3;

a motor rotating the impeller in a manner centering on the center axis;

a casing having an inlet opening and an outlet opening connected to each other via a through hole defined by a radially inner surface; wherein the radially inner surface of the casing radially surrounds the impeller; and an outlet-opening side of the casing includes a taper portion arranged such that the through hole gradually expands in size.

5. The axial flow fan as set forth in claim 4, wherein the casing has a contour having a substantially quadrangle shape when viewed along the center axis, and the taper portion is arranged radially inside of a corner of the contour such that the through hole gradually expands toward the corner of the contour along the center axis.

6. The axial flow fan as set forth in claim 4, wherein the first corner is arranged in an inlet side along the center axis from the taper portion.

7. The axial flow fan as set forth in claim 4, further comprising:

a base portion which supports the motor thereon; and a rib radially outwardly extending from the base portion to the radially inner surface of the casing to support the base in the through hole; wherein the rib has a teardrop shape having a rounded head and a frustum tail in a cross section along a virtual circle centered on the center axis; and the rounded head is arranged rearward relative the frustum tail in the rotational direction.

8. The impeller as set forth in claim 1, wherein a tangent line to any point on the leading edge and the following edge radially outwardly extends forward in the rotational direction from an intersection with a line connecting the center axis and said any point in a plan view along the center axis.

9. The impeller as set forth in claim 1, wherein each of the plurality of blades is cambered rearward in the rotational direction in a cross section of each of the plurality of blades along a virtual circle centered on the center axis, and each of the plurality of blades has a greater camber as a radius of the virtual circle becomes greater.

10. The impeller as set forth claim 9, wherein a camber ratio of each of the plurality of blades is defined by a ratio of a maximum distance between a center line passing a middle of each of the plurality of blades and a chord line connecting the following edge and the leading edge in a direction substantially perpendicular to the chord line to a length of the chord line in the cross section of each of the plurality of blades along the virtual circle centered on the center axis, and a camber ratio monotonically increases from a joint where each of the plurality of blades meets the radially outer surface of the hub to the radially outer edge of each of the plurality of blades, such that each of the plurality of blades has a minimum camber ratio at the joint and a maximum camber ratio at the radially outer edge.

11. An axial flow fan comprising:

the impeller as set forth in claim 10;

a motor rotating the impeller in a manner centering on the center axis;

a casing having an inlet opening and an outlet opening connected to each other via a through hole defined by a radially inner surface; wherein the radially inner surface of the casing radially surrounds the impeller; and an outlet-opening side of the casing includes a taper portion arranged such that the through hole gradually expands in size.

12. The axial flow fan as set forth in claim 11, wherein the casing has a contour having a substantially quadrangle shape when viewed along the center axis, and the taper portion is arranged radially inside of a corner of the contour such that the through hole gradually expands toward the corner of the contour along the center axis.

13. The axial flow fan as set forth in claim 11, wherein the first corner is arranged in an inlet side along the center axis from the taper portion.

14. The axial flow fan as set forth in claim 11, further comprising:

a base portion which supports the motor thereon; and a rib radially outwardly extending from the base portion to the radially inner surface of the casing to support the base portion in the through hole; wherein the rib has a teardrop shape having a rounded head and a frustum tail in a cross section along a virtual circle centered on the center axis; and the rounded head is arranged rearward relative to the frustum tail in the rotational direction.

15. An impeller for use in an axial flow fan, the impeller comprising:

a hub including a radially outer surface and centered on a center axis; and a plurality of blades extending radially outwardly from the radially outer surface of the hub to generate an air flow along the center axis when the hub rotates in a rotational direction, each of the plurality of blades includes a leading edge which is a forward side edge in the rotational direction, a following edge which is a rearward side edge in the rotational direction, and a radially outer edge connecting the leading edge and the following edge; wherein a first corner where the radially outer edge and the following edge meet is arranged forward in the rotational direction relative to a second corner where the radially outer surface of the hub and the leading edge meet in each of the plurality of blades; and each of the plurality of blades is cambered rearward in the rotational direction in a cross section of each of the plurality of blades along a virtual circle centered on the center axis, and each of the plurality of blades has a greater camber as a radius of the virtual circle becomes greater.

16. The impeller as set forth claim 15, wherein a camber ratio of each of the plurality of blades is defined by a ratio of a maximum distance between a center line passing a middle of each of the plurality of blades and a chord line connecting the following edge and the leading edge in a direction substantially perpendicular to the chord line to a length of the chord line in the cross section of each of the plurality of blades along the virtual circle centered on the center axis, and a camber ratio monotonically increases from a joint where each of the plurality of blades meets the radially outer surface of the hub to the radially outer edge of each of the plurality of blades, such that each of the plurality of blades has a minimum camber ratio at the joint and a maximum camber ratio at the radially outer edge.

17. An axial flow fan comprising:

the impeller as set forth in claim 15;

a motor rotating the impeller in a manner centering on the center axis;

a casing having an inlet opening and an outlet opening connected to each other via a through hole defined by a radially inner surface;

wherein the radially inner surface of the casing radially surrounds the impeller; and an outlet-opening side of the casing includes a taper portion arranged such that the through hole gradually expands in size.

18. The axial flow fan as set forth in claim 17, wherein the casing has a contour having a substantially quadrangle shape when viewed along the center axis, and the taper portion is arranged radially inside of a corner of the contour such that the through hole gradually expands toward the corner of the contour along the center axis.

19. The axial flow fan as set forth in claim 17, wherein the first corner is arranged in an inlet side along the center axis from the taper portion.

20. The axial flow fan as set forth in claim 17, further comprising:

a base portion which supports the motor thereon; and a rib radially outwardly extending from the base portion to the radially inner surface of the casing to support the base portion in the through hole; wherein the rib has a teardrop shape having a rounded head and a frustum tail in a cross section along a virtual circle centered on the center axis; and the rounded head is arranged rearward relative to the frustum tail in the rotational direction.

* * * * *